US005626193A

United States Patent [19]

Nzekwu et al.

[11] Patent Number: 5,626,193

[45] Date of Patent: May 6, 1997

[54] SINGLE HORIZONTAL WELLBORE GRAVITY DRAINAGE ASSISTED STEAM FLOODING PROCESS

[75] Inventors: Ben I. Nzekwu; Peter D. Sametz; Peter J. Pelensky, all of Calgary, Canada

[73] Assignee: Elan Energy Inc., Calgury, Canada

[21] Appl. No.: 420,038

[22] Filed: Apr. 11, 1995

[51] Int. Cl.[6] ..... E21B 43/24

[52] U.S. Cl. ..... 166/303; 166/50

[58] Field of Search ..... 166/50, 303, 272

[56] References Cited

U.S. PATENT DOCUMENTS

| | | | |
|---|---|---|---|
| 4,067,391 | 1/1978 | Dewell | 166/303 |
| 4,116,275 | 9/1978 | Butler et al. | 166/303 |
| 4,217,956 | 8/1980 | Goss et al. | 166/272 |
| 4,344,485 | 8/1982 | Butler | 166/271 |
| 4,460,044 | 7/1984 | Porter | 166/252 |
| 4,465,137 | 8/1984 | Sustek, Jr. et al. | 166/272 |
| 4,565,245 | 1/1986 | Mims et al. | 166/50 |
| 4,640,359 | 2/1987 | Livesey et al. | 166/276 |
| 4,700,779 | 10/1987 | Huang et al. | 166/263 |
| 4,892,146 | 1/1990 | Shen | 166/270 |
| 5,141,054 | 8/1992 | Alameddine et al. | 166/50 X |
| 5,148,869 | 9/1992 | Sanchez | 166/303 |
| 5,167,280 | 12/1992 | Sanchez et al. | 166/267 |
| 5,207,271 | 5/1993 | Sanchez et al. | 166/281 |
| 5,215,146 | 6/1993 | Sanchez | 166/263 |
| 5,215,149 | 6/1993 | Lu | 166/303 |
| 5,289,881 | 3/1994 | Schuh | 166/303 |
| 5,291,956 | 3/1994 | Mueller et al. | 175/67 |
| 5,297,627 | 3/1994 | Sanchez et al. | 166/272 |

FOREIGN PATENT DOCUMENTS 1260826 9/1989 Canada .

OTHER PUBLICATIONS

Huygen et al., "Steaming Through Horizontal Wells and Fractures – Sealed Model Tests", European Symposium of Enhanced Oil Recovery, Paris, Nov. 1982.

Best et al., "Steam Circulation in Horizontal Wellbores", SPE/DOE Seventh Symposium on Enhanced Oil Recovery, Tulsa, OK, Apr. 22–25, 1990.

D.E. Carpenter, "Horizontal Wells in a Steamdrive in the Midway Sunset Field", Proceedings from the 24th Annual Offshore Technology Conference, Houston, Texas, vol. 4, pp. 385–395 (May 1992).

*Primary Examiner*—Hoang C. Dang

*Attorney, Agent, or Firm*—Schwegman, Lundberg, Woessner & Kluth, P.A.

[57] ABSTRACT

Disclosed is a gravity-drainage assisted steam flooding process for the recovery of all from thin viscous heavy oil reservoirs using a single horizontal wellbore. Steam is injected through a fully or partially insulated tubing to exit at or near the toe of a long horizontal well penetrating a viscous oil reservoir. Initially, low (10–30%) quality steam is circulated along the well to condition the wellbore and increase the heated radius to about 1 or 2 meters. Oil and reservoir fluids immediately adjacent to the wellbore are produced through the annular space between the insulated tubing string and a slotted liner that surrounds it. After the period of low quality steam circulation, the production outlet is shut in or constrained and steam injection is continued to initiate an active steam chamber zone along a portion of the wellbore. Subsequently, fluid withdrawal is resumed at the production outlet, while the annular liquid level in the vertical section is controlled to maintain a nearly constant pressure at the production outlet. The injection of a higher (50–70% or more) quality steam is continued at a rate similar to or higher than the initial rate to cause the expansion and propagation of the active steam heated volume vertically towards the top of the formation, longitudinally along the horizontal well from the toe towards its heel, and laterally away from the well towards the inter-well boundary with the next row of horizontal well. As steam flows into the reservoir under both gravitational counter current flow and pressure drive, the oil, steam condensate and reservoir fluids heated both conductively and convectively drain towards the slotted liner annulus of the horizontal wellbore and is then pumped to the surface.

20 Claims, 3 Drawing Sheets

SINGLE HORIZONTAL WELLBORE GRAVITY DRAINAGE ASSISTED STEAM FLOODING PROCESS

FIELD OF THE INVENTION

This invention relates to a process for the recovery of viscous hydrocarbons from subterranean oil reservoirs by injecting steam and withdrawing oil and condensed steam from a single horizontal producing well.

BACKGROUND OF THE INVENTION

The deposits of Canadian heavy oil found in the Lloydminster reservoirs exist in thin zones, often only 5 to 20 meters thick, but of considerable lateral extent and sometimes underlain by bottom water. Unlike the bitumen deposits in the Athabasca and Cold Lake reservoirs which are essentially immobile, oil from these unconsolidated deposits flows under normal solution-gas drive primary recovery mechanisms. With the recent introduction of horizontal well drilling, conventional exploitation of these deposits by vertical wells has now been replaced by horizontal wells, sometimes as much as 1000 meters long. The primary recovery scheme now takes advantage of the large contact area possible between the reservoir and the long horizontal wellbore, in addition to the reduced inflow pressure gradients. Oil production (withdrawal) at rates much higher than with the vertical wells in now easily achievable.

One consequence of the rapid and large withdrawal rates from these reservoirs is the equally rapid reduction of reservoir pressure. Additionally, a significant amount of sand is sometimes produced with the oil due to the unconsolidated nature of the formation, and this results in highly expensive well cleanout procedures. As a result, total recoverable oil from these pools is generally no higher than 15% of the original in-place hydrocarbons. Since this primary production phase leaves the reservoir highly pressure depleted yet saturated with at least 80% of the original oil, some form of supplemental or enhanced recovery process is needed to produce additional oil from the reservoir. Among the various possible processes for recovery of this oil, steam injection is generally regarded as the most economical and efficient. Steam can be used to heat the oil, reducing its viscosity and thereby improving its ability to flow to the production well. In some instances steam is also used to drive the mobilized heated oil towards the production means.

Some of the current practices for transporting the steam heat into the reservoir to heat the oil include the use of:

(a) vertical steam injection wells drilled to the same depth as the horizontal producing well, but located at some lateral distance from the horizontal producing well;

(b) vertical steam injectors drilled into the same formation but located immediately above the horizontal producing well;

(c) horizontal steam injectors drilled parallel to the horizontal producing well but located at the same or slightly higher reservoir depth and at considerable lateral distance from the horizontal producing well;

(d) horizontal steam injectors drilled into the same formation but located vertically above the horizontal producing wells.

All these steam injection schemes and well configurations have unique characteristics that make them inadequate for enhanced recovery from the thin mobile heavy oil reservoirs.

In case (a), injected steam must sweep through the inter-well distance between the vertical injector well and the horizontal producing well and, in the process, transfer heat to mobilize the oil which is then produced through the horizontal well. However, it has been found that the high pressures required to inject and disperse the steam towards the horizontal wells also create stress changes in the reservoir. These stresses cause increased movement of sand which inhibits oil production at the well. Additionally, the development of preferred high flow paths between the vertical injector and the horizontal producing well creates a short circuit for steam flow and causes excessive steam production and severe operational problems. As a result of gravity override, the vertical shape of the preferred path limits the area available for heat transfer from steam and hot condensate to make the recovery process economic.

In case (b), thin heavy oil reservoirs do not provide sufficient vertical space to allow placement of a vertical injector above the horizontal production well, especially if there is a bottom water zone below. Also, with injection directly above the producer, the potential for sand displacement into the producing well is increased. Furthermore, more than one vertical steam injector will generally be required to cover the span of the horizontal well adding to the increased cost for this scheme.

Case (c) is illustrated by Canadian Patent 1,260,826 (also U.S. Pat. No. 4,700,779 issued Oct. 20, 1987) issued on Sep. 26, 1989 to Huang et al which discloses a method of recovering hydrocarbons using parallel horizontal wells as steam injection and production wells. Steam is injected into two parallel horizontal wells to stimulate the formation and then the second horizontal well is converted to a production well. However, such steam injection method may not be advantageous if no control is applied to the manner of steam outflow into the reservoir. Steam injected into a horizontal well may not be distributed uniformly into the reservoir because steam flow in the reservoir is usually controlled by heterogeneity along the well. U.S. Pat. No. 5,141,054 issued Aug. 25, 1992 to Alameddine et al. teaches a method of steam injection down a specially perforated tubing to cause uniform steam injection by choked flow and uniform heating along the wellbore.

Case (d) refers to processes based on U.S. Pat. No. 4,344,485 issued Aug. 17, 1982 to Butler which teaches a Steam Assisted Gravity Drainage technique where pairs of horizontal wells, one vertically above the other, are connected by a vertical fracture. A steam chamber rises above the upper well, and, oil warmed by conduction drains along the outside chamber to the lower production well. However, for the thin heavy viscous oil reservoirs, two problems can be identified: firstly, the additional expense required to drill a second horizontal steam injection well above the horizontal producer makes the process uneconomical; secondly, in thin reservoirs there is insufficient vertical space in which to drill another horizontal well within an acceptable vertical distance from the horizontal producer.

Recently, a number of patents have pursued the concept of single horizontal wellbore oil recovery methods. U.S. Pat. No. 5,167,280 issued Dec. 1, 1992 to Sanchez and Hazlett discloses a solvent stimulation process for tar sands reservoirs whereby a viscosity reducing agent is circulated through an inner tubing string into a perforated horizontal well. The recovery of oil is achieved by diffusion of the solvent/solute mixture into the reservoir, and removal of the oil along the horizontal well as the solvent circulation continues. However, despite the recommended use of horizontal wells, solvent processes are commercially impractical because they require long soak times during which the solvent and oil must remain in contact to have any mixing.

Also, the wellbore pressure must be lower than the reservoir pressure in order to promote solvent diffusion. Under these conditions, the proportion of injected solvent which preferentially flows out of the reservoir will be substantially greater than that which rises into the reservoir, thus decreasing the effectiveness of the process.

U.S. Pat. No. 4,116,275 issued Sep. 26, 1978 to Butler et al. discloses a cyclic steam stimulation method of recovering hydrocarbon from tar sands formations via a horizontal wellbore completed with slotted or perforated casing means and with dual concentric tubing strings forming two annular spaces. Steam is injected into the reservoir through the second annular space between the liner or perforated casing and the outer tubing, while gas is introduced as insulating medium in the first annular space. Heated oil and steam condensate are produced to the surface through the inner tubing string.

U.S. Pat. No. 5,148,869 issued Sep. 22, 1992 to Sanchez discloses a single wellbore method and apparatus for in-situ extraction of viscous oil by gravity action using steam plus solvent vapour. One serious limitation of this invention in a practical application is that the method hinges on the use of a specially designed horizontal wellbore containing two compartments. Steam flows into the formation through a condult perforated only along the upper portion of the horizontal wellbore, while oil and condensate flowing downwardly from the reservoir collect in a pool around the wellbore and is pulled into an inner compartment perforated essentially only along the base of the wellbore. Using this apparatus with steam injection into the upper perforated conduit, it would be nearly impossible to transport steam effectively to the toe of the horizontal well or distribute the steam uniformly along the well without a short circuit to the production conduit below.

U.S. Pat. No. 5,215,149 issued Jun. 1, 1993 to Lu discloses a process where heavy oil is recovered from reservoirs with limited native injectivity and a high water-saturated bottom water zone. The horizontal wellbore is perforated only on its top side at selected intervals. It contains an uninsulated tubing string inserted to the farthest end. A thermal packer is placed around the tubing to form two separated, spaced-apart perforated intervals along the horizontal well. Thereafter, steam is injected into the reservoir via the perforated interval near the heel of the horizontal well, while oil and steam condensate are removed via the inner tubing string at the distal and of the horizontal wellbore. Three problems can be identified in the application of this process to an unconsolidated heavy oil reservoir. First, a large amount of sand will be transported into the inner production tubing as the steam sweeps through one set of perforation interval then through the reservoir and is produced through the other set of perforated intervals. Secondly, once a communication path is established between the injection interval and production interval, steam will find an easy way to short circuit the reservoir resulting in poor displacement efficiency. Additionally, the scheme will promote very high heat losses as the produced fluids flowing through the tubing are heated by the steam as it enters the heel of the horizontal well.

As indicated, the referenced patents individually have severe limitations which make the processes described impractical and/or uneconomic for field implementation, particularly in an unconsolidated heavy oil reservoir. What is needed is an economic method to thermally stimulate the viscous oil in these reservoirs using the same horizontal wellbores as have already been used for primary production.

SUMMARY OF THE INVENTION

Accordingly, this invention provides a method for recovering heavy oil from reservoirs in thin formations, which formations are provided with a drilled and cased well having the vertical section of the well cemented. The well has a vertical portion and a horizontal portion wherein there is a foraminous liner along the horizontal portion. The horizontal portion has a proximal end and a distal end. The method provides an insulated steam injection tubing within the vertical and horizontal portions of the well, extending to near the distal end of the horizontal portion. A production tubing is provided within the vertical portion of the well terminating adjacent the lower end of the vertical portion of the well. Steam vapour and hot water condensate are injected into the steam injection tubing whereby a portion of the injected steam flows through the liner back towards the vertical portion of the well. The injected steam vapour rises and is driven by pressure and buoyancy vertically into the reservoir and heats the oil and the heated oil and steam condensate drain downward and towards the proximal end of the horizontal portion through the foraminous liner into said annulus and are transported to the surface through said production tubing.

It is therefore a primary aspect of one embodiment of this invention to provide an economically viable method to recover viscous oil in an unconsolidated heavy oil reservoir using the same horizontal wells as have already been used for primary production.

It is another aspect of an embodiment of this invention to promote the enhanced or supplemental recovery of oil from unconsolidated heavy oil reservoirs with a gravity assisted process using a single horizontal wellbore.

It is another aspect of an embodiment of this invention to promote counter-current flow of injected steam rising and driven by pressure and buoyancy in the formation and heated oil and steam condensate draining downwardly to the horizontal producer.

It is another aspect of an embodiment of this invention to accelerate the gravity drainage recovery process by taking advantage of the pressure drop in the annular space formed by an insulated tubing string and a slotted liner or perforated casing to initiate a partial steam drive process, to drive the steam chamber from the toe of the well towards the heel.

It is another aspect of an embodiment of this invention to provide a continuous thermally enhanced oil production process from a single horizontal wellbore at the end of the primary production operation.

It is another aspect of an embodiment of this invention to provide a commercially viable oil production method which substantially reduces sand production during oil inflow into a single horizontal wellbore.

DESCRIPTION OF THE PREFERRED EMBODIMENTS

Figure 1:
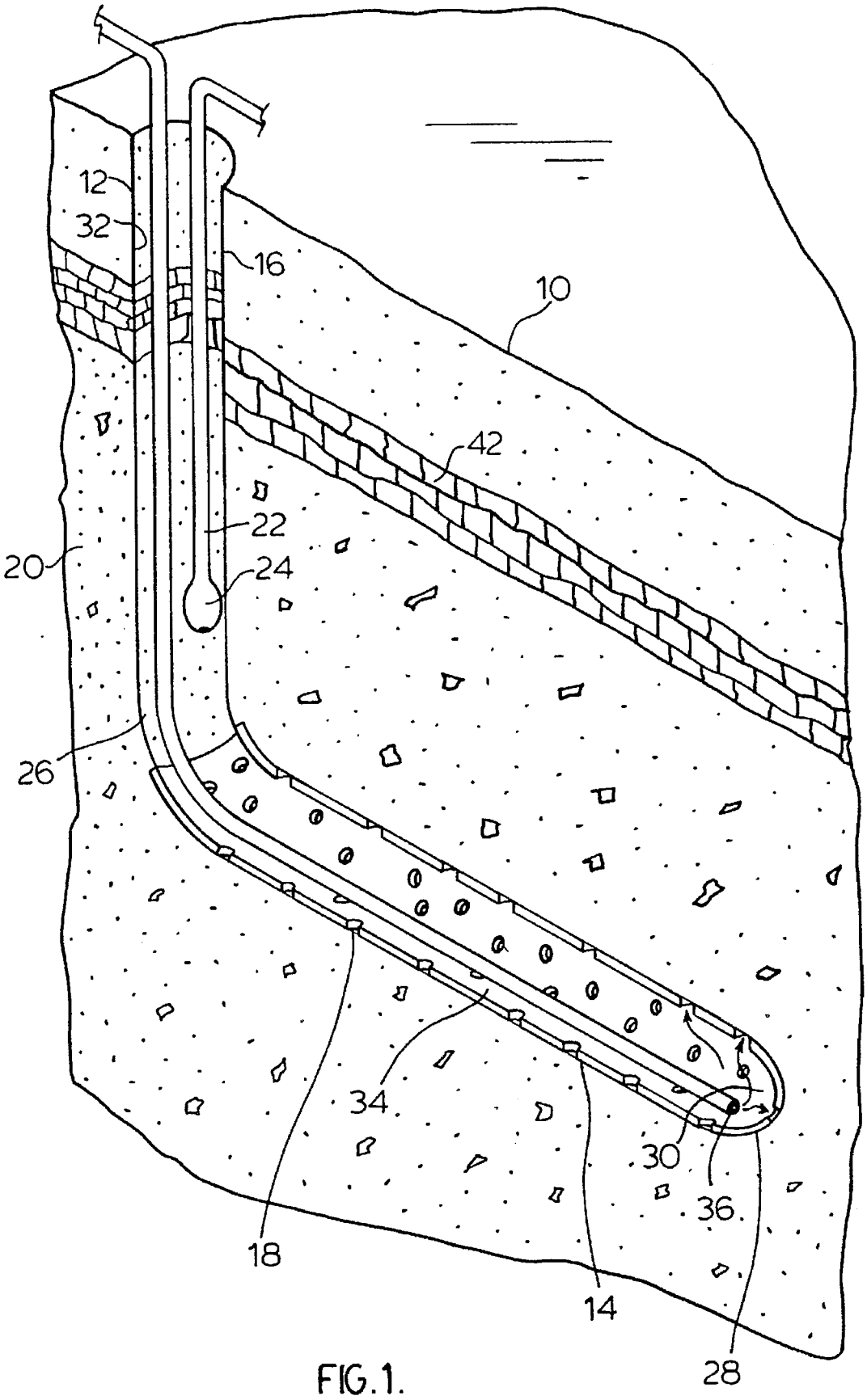
FIG. 1 is a cross-sectional perspective view through a heavy oil reservoir and the horizontal wellbore which penetrates the hydrocarbon-bearing zone.

Referring to FIG. 1, the drawing illustrates a subterranean unconsolidated formation or reservoir 10, which contains initially mobile or partially mobile but viscous heavy oil deposit. A wellbore having a substantially vertical section 12 and a substantially horizontal section 14 penetrates the formation. The techniques for drilling a horizontally deviated wellbore are well established and will not be discussed further. A continuous casing element 16 extending through the vertical section is cemented to the surrounding earth with preferably thermally stable cement. Though the described process can be applied to non-thermally equipped wells especially for lower pressure operations, a thermally-stable cement avoids potential heat damage to the vertical section of the well. The horizontal section 14 is completed with a slotted liner 18 having perforations extending essentially along the entire length of the wellbore. Initially oil is recovered from the reservoir under primary production, solution-gas drive mechanisms. While initial production is not a condition for the application of this invention, it improves the injectivity of steam in the follow-up process.

At the end of the primary recovery period, after approximately 5 to 10% of the initially in-place hydrocarbon is recovered, the well is recompleted to contain two tubing strings 20 and 22 of diameter much smaller than the diameter of casing. One of these strings, the production tubing string 20, is disposed in the well and terminates at a downhole production pump 24 set near the beginning or heel 26 of the horizontal section of the wellbore. The second string (the insulated steam injection tubing string 22) is also disposed in the horizontal wellbore and extends from the surface to within 20 to 50 meters of the distal end or toe 28 of the horizontal wellbore 14. By placing the injection tubing 20 to 50 meters short of the distal end of the wellbore, a buffer zone 30 is created in a region of maximum pressure forces. This allows accumulation of sand that might inadvertently drop into the buffer zone 30 of the horizontal section 14 during higher injection pressures due to the unconsolidated nature of the sand. An annulus 34 is defined between the steam tubing and the slotted liner 18.

Three major stages of the method which is the subject of this patent are summarized as follows:

Step I: Wellbore conditioning and cleaning phase

This stage is intended to conductively heat up the horizontal wellbore through hot fluid circulation and thus increase the heated radius within the reservoir to about 1 or 2 meters. The duration of this phase should be up to 45 to 60 days depending on length of the well and volume of steam that can be delivered through the injection tubing. A hot wellbore area ensures that the viscosity of the oil flowing in the region is sufficiently reduced compared to the viscosity of unheated oil. This results in the sand-carrying capacity of the oil being drastically reduced as the oil and hot condensate drain through this region into the wellbore. Hot fluid circulation also cleans up the wellbore after primary production and conditions the surrounding reservoir for the steam chamber development phase. A final near wellbore temperature of about 150° C. is considered adequate. For oil sands and bitumen reservoirs where the oil is initially immobile, this circulation step could take up to 90 days to adequately heat up the wellbore region along the horizontal well.

For lower pressure reservoirs, as the circulation phase matures, the withdrawal of oil and hot condensate should be controlled such that an annular liquid column 32 is established within the vertical section 12 to provide a bottomhole pressure close to the desired operating pressure. Using this method of downhole pressure control, the method of the invention can be operated under a wide range of reservoir pressures, and would be particularly suitable to low pressure and pressure-depleted reservoirs. For these applications, a smaller liquid head is required in the vertical section and this determines the operating pressure and hence the effective steam temperature regime.

For higher pressure reservoirs, it is not necessary to establish a liquid head equivalent to the pressure in the reservoir. Because of the strong communication with the annulus, the annular liquid level established controls both the annulus pressure and the steam pressure and temperature at the distal end of the injection tubing. Since the surrounding reservoir is at a pressure higher than the annulus pressure, the additional pressure drop aids the movement of heated oil and condensate towards the slotted liner.

Step II: Steam chamber initiation phase

Because of the limited voldage within the reservoir in the region of the distal end of the horizontal well at the start of the operation (maximum about 10%), initial steam rise into the reservoir along a long horizontal well is by buoancy (gravitational flow, i.e. due to the density difference between steam vapour and the resident reservoir fluids). While gravitational flow is persistent as heated oil and steam condensate continuously drain into the wellbore, it is generally a slow process. To accelerate the oil recovery process, this invention develops a steam chamber over part (approximately 10 to 20%) of the horizontal well. To achieve this, a greater amount of the injected steam has to be forced into the reservoir. With the strong communication between the steam tubing 22, the annulus 34 and the production tubing 20, a significant steam chamber cannot be formed without restricting steam production. This is particularly important for short horizontal wellbores. The production of steam can be restricted by two means:

(a) by producing oil and steam condensate at reduced rates to build an annular liquid level in the vertical section 12; or (b) by shutting in the production for the duration of this stage.

In the preferred embodiment of the invention, high quality steam (greater than 50%) is injected at moderate rates but especially at pressure below the fracture pressure of the reservoir. A thermocouple 36 placed at the toe of the well can be used to monitor wellbore temperature at the steam exit and provide an estimate of this injection pressure. For unconsolidated formations, excessive pressure changes can fracture the reservoir or cause severe sand movement within the near well region, and should be avoided. The duration of the chamber initiation phase is about 30 days.

Step III: Chamber propagation

Figure 2A:
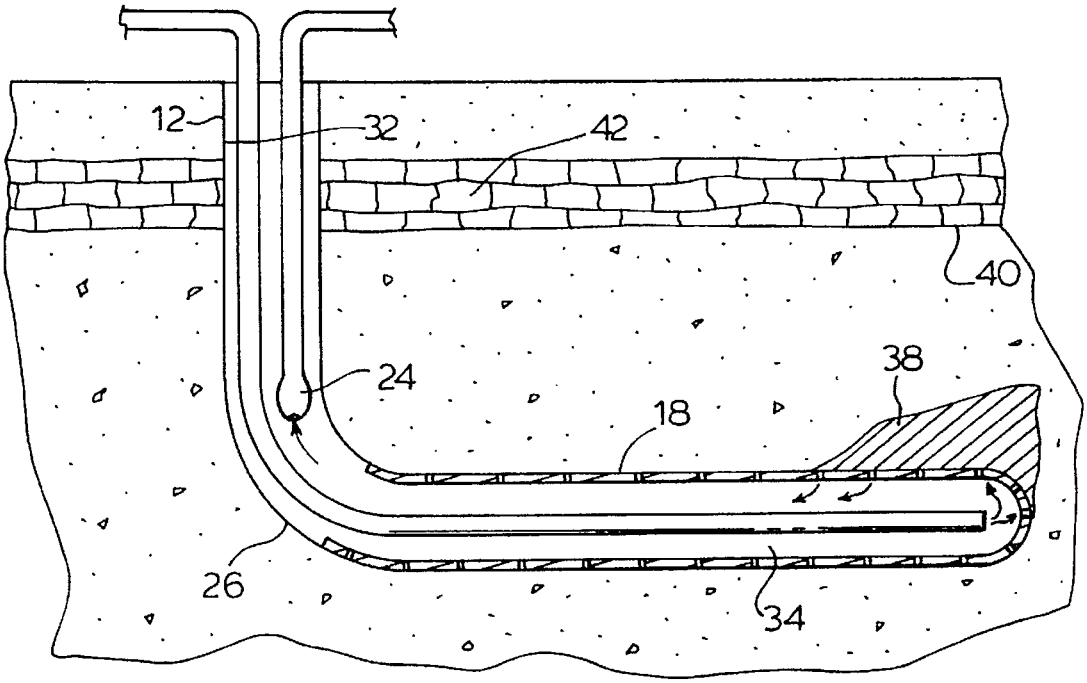
FIG. 2 is a schematic cross-sectional view of the horizontal wellbore of FIG. 1 illustrating the various stages in the development and movement of the steam chamber along the horizontal wellbore during the recovery process according to the invention.

Having developed a steam chamber 38 along and especially at the toe of the horizontal well (FIG. 2*a*), the last stage in the process is the expansion and propagation of the chamber across the drainage area of the horizontal well. At this point the bottomhole production pump is operated to ensure maximum-liquid withdrawal, but at a rate that maintains the desired annular fluid level within the vertical section 12 of the well, without hindrance to the continued propagation of the steam chamber. A constant or nearly constant annular fluid level is a measure of the pressure exerted at the production end and causes the reservoir into a gravity dominated distribution of pressures within the reservoir. As steam rises, heated oil and steam condensate drains downward to the perforated horizontal wellbore. The steam chamber 38 grows vertically towards the top of the reservoir under the influence of bouancy. The longitudinal growth of the chamber along the horizontal well, i.e. from the toe towards the heel is promoted by the steam drive effect due to two forces, namely the pressure increase caused by the injection of steam at the toe of the well and small pressure drop that exists along the horizontal well as a result of friction in the annular space between the insulated injection tubing and the slotted liner. The lateral propagation of the chamber from the wellbore occurs as a result of heat conduction from the chamber along with convective flow due to higher steam injection pressures.

Figure 2B:
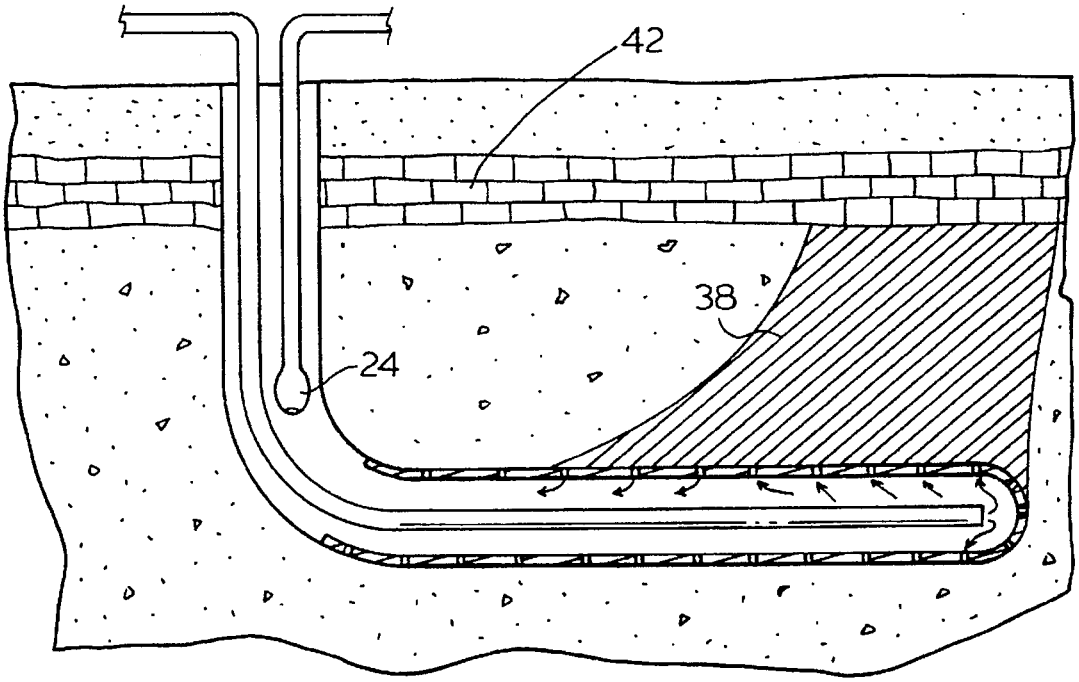
Figure 2C:
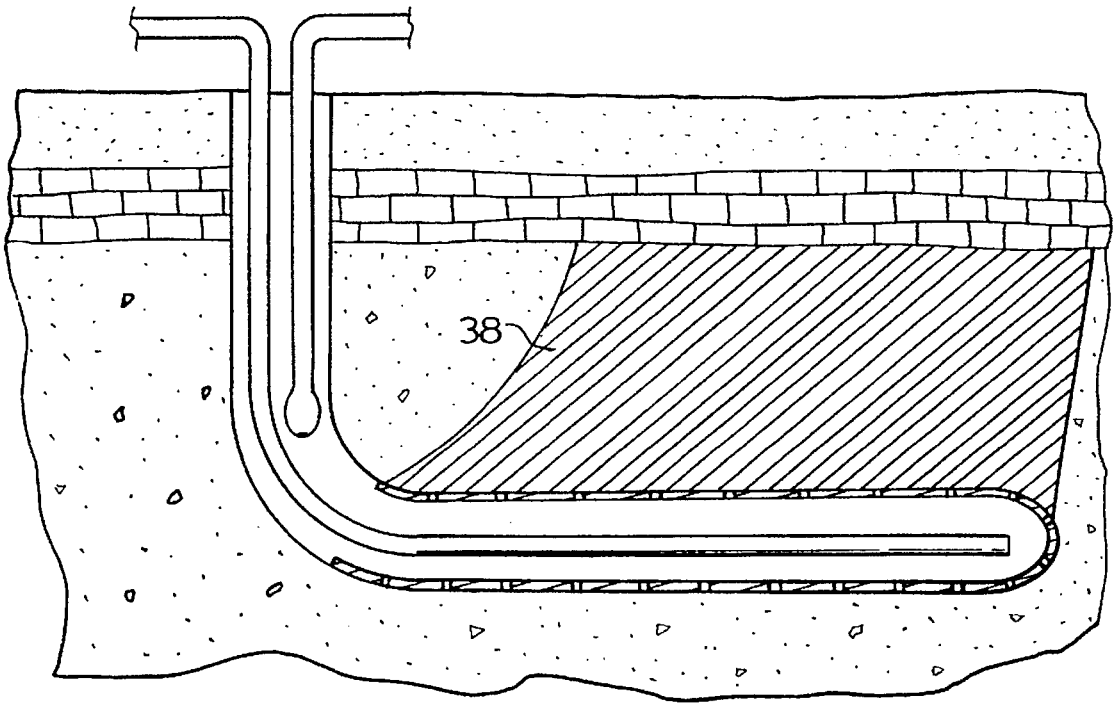

FIG. 2 illustrates the stages of the development and propagation of the steam chamber in the gravity-drainage assisted single horizontal wellbore steamflood process. As steam flows through the steam injection tubing string 22, it conductively heats the fluid in the annulus 34 which then conductively heats the fluids and surrounding reservoir 10. The effect of the insulation on the steam injection tubing string 22 is to moderate the heat transfer so that a fairly high quality steam can reach the distal end 28 of the wellbore. Because of the low pressure drop in the annulus 34, the steam flows into the annulus 34 and is distributed along the length of the horizontal well towards the production outlet pump 24. The constant pressure production due to the height of the liquid column 32 in the vertical section 12 constrains the reservoir to operate under a gravity dominated mode resulting in the buoyant rise of steam out through the slotted liner 18 and the counter-current flow of heated oil and steam condensate draining downwardly into the annulus 34. This process takes place along the entire horizontal section resulting in considerable oil production.

Because the pressure and temperature at the distal end 28 of the wellbore is greater than the pressure and temperature in the reservoir, a steam chamber 38 develops preferentially at the distal end 28 of the horizontal wellbore. The greater steam influx into this region and more rapid draining of oil and condensate allows the chamber to grow faster, advancing vertically towards the top 40 of the reservoir 10 and also laterally into the interwell region. Step II in the prescribed invention is designed to accelerate the initiation of this chamber in reservoirs where initial depletion is low. As more steam is injected, the constant drainage of reservoir fluids along the horizontal well aids the longitudinal growth of the steam chamber 38 towards the heel 26 of the horizontal well. The heat loss to the overburden 42 which is initially low increases as the steam chamber reaches the top 40 of the formation 10 along which it spreads with continued steam injection. In some reservoirs, non-condensible gases released from the oil due to the reaction with steam often accumulate at the top of the reservoir and can serve to cushion off the heat loss to the overburden 42. This can be supplemented with the injection of a non-condensible gas such as nitrogen with the steam.

Figure 3:
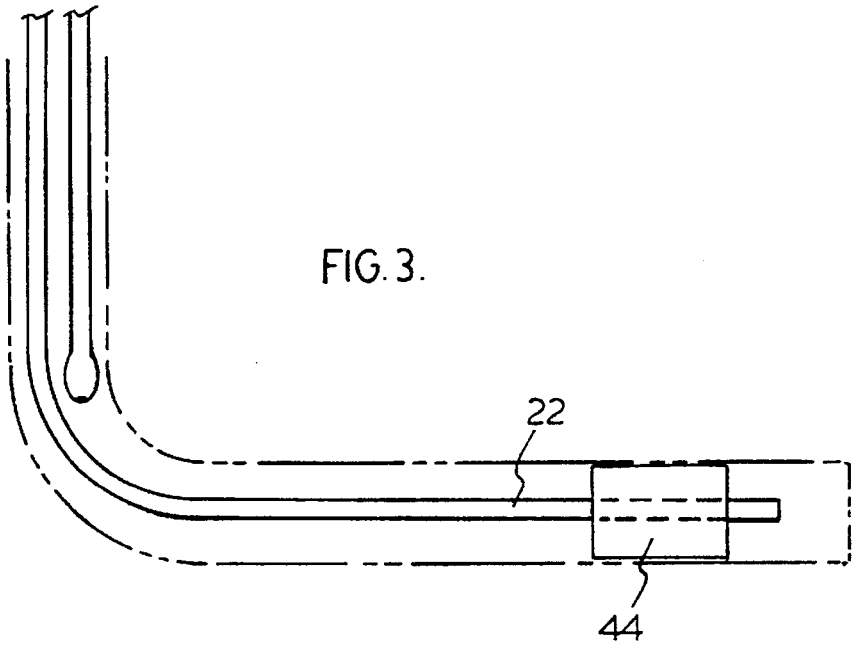
FIG. 3 is a schematic cross-sectional view of the distal end of the wellbore of FIG. 1 illustrating the use of a thermal packer with an embodiment of the invention.

The penetration of the steam into the reservoir can be increased by using a thermal packer 44 installed at the distal end of the steam injection tube 22, as shown in FIG. 3. The thermal packer blocks the annulus and allows the steam to be injected at greater pressure into the reservoir.

The packer is placed within a blank section of liner material near the exit end of the tubing. The packer which is usually no more than one meter long divides this annulus section with one pressure on the proximal end and another pressure at the distal end. Without a packer the pressures are nearly equal. With a packer, the direct communication between the exit end of the injection tubing and the annulus is partially blocked so that pressure on the distal end is higher. This increased pressure will force more steam and condensate directly into the reservoir. The injected fluid stream does not return directly to the annulus but must first flow through the reservoir. The heated oil and steam condensate eventually flow back to the annulus at the proximal end of the packer. In this application, the packer is run in the horizontal well unset or in the open position at the distal end of the steam tubing. The setting is accomplished remotely after placement or can be thermally activated as the high temperature steam is injected.

In some heavy oil reservoirs, the bottom of the formation contains various thickness of bottom water zones. Ordinarily, oil production from the horizontal well will usually be accompanied by large water production as the oil-water contact between the oil layer at the top and the bottom water zone is pulled into the well. The constant pressure operation described in this invention is particularly suited to such reservoir. In the absence of any appreciable pressure drawdown, the oil-water contact remains virtually undisturbed and the oil can be produced without massive water influx.

In a number of horizontal well applications in heavy oil reservoirs with moderately thick or active bottom water zones or aquifers, the horizontal wells are frequently located much higher in the formation to avoid the influx of the water. In applying the present invention to such a well arrangement, the initial formation of a steam chamber is not a high priority. The required enhancement in oil production can be obtained by heat addition mostly by conductive heating to the near-well region. In such an application, it is necessary to insulate only a section of the injection tubing along the horizontal section to increase the conductive heating along the wellbore. To maintain a constant oil-water contact, the process will then be operated at a constant pressure close to the pressure in the aquifer.

When reservoir pressure is not sufficient to sustain flow of oil to the surface at adequate rates, the natural flow must be aided by artificial lift. The preferred mode of artificial lift system described in this invention is a downhole productions pump 24 to lift the heated oil and condensate to the surface. However, this artificial lift can also be accomplished using a gas (hence a gas lift).

In the case of a gas lift, the gas is injected from the surface into the lower part of the production tubing to aerate the fluid, reduce the pressure gradient and cause the fluid to flow to the surface, and also reduce the back pressure at the formation. The method and design of a gas lift system is well known to those familiar with the art. In this application, the gas is injected into the annular space in the vertical section of the well where gas inlet valves provided in the vertical tubing allow entry of gas into the production tubing where it mixes with the produced fluids, decreases the flowing pressure gradient and thus lowers the bottomhole flowing pressure.

Various modifications and alterations of this invention will become apparent to those skilled in the art without departing from the scope and spirit of this invention. It should be understood that this invention is not to be unduly limited to that set forth herein for illustrative purposes. The process can be applied without significant changes to a variety of reservoir types and thicknesses including fractured, consolidated and partially consolidated heavy oil reservoirs, oil sands and bitumen reservoirs, with or without bottom water. The invention can also be applied to these reservoirs as grassroot processes without the need for an initial primary production. This is particularly relevant to reservoirs with an active bottom water zone.

What we claim is:

1. A method for recovering heavy oil from reservoirs in thin formations, which formations are provided with a drilled, cased and cemented well having a vertical portion and a horizontal portion wherein there is a foraminous liner along the horizontal portion, the horizontal portion having a proximal end and a distal end extending into a wellbore, said method comprising:

(a) providing a steam injection tubing within the vertical and horizontal portions of the well, said tubing extending to near the distal end of said horizontal portion and being provided with insulation along said vertical portion and along said horizontal portion and extending towards said distal end substantially to said distal end to provide a minimal temperature gradient along said tubing;

(b) providing a production tubing within the vertical portion of the well terminating adjacent the lower end of the vertical portion of the well;

(c) injecting steam vapour and hot water condensate into the steam injection tubing to effect flow of a first portion of said steam vapour and hot water condensate along the liner back towards the vertical portion of the well and to effect transfer of a second portion of said steam vapour into said formation, the second portion of the injected steam vapour rising vertically into the reservoir and heating the oil to effect drainage of steam condensate and oil downward and towards said proximal end of the horizontal portion and drainage of steam condensate and oil through said foraminous liner to be transported to said surface through said production tubing.

2. The method of claim 1 wherein said steam vapour and hot water condensate are injected in two stages:

a. an initial stage wherein the steam quality is low; and b. a subsequent stage wherein the steam quality is high.

3. The method of claim 2 wherein the steam quality in said initial stage is between approximately 10 and 30% and the steam quality in said subsequent stage is above about 50%.

4. The method of claim 3 wherein the initial stage results in the removal of reservoir fluids and the heating of the region of the reservoir within a radius of approximately 1 to 2 meters of the horizontal portion.

5. The method of claim 4 wherein during the subsequent stage, production from the well is decreased so as to increase the well pressure and thereby increase the amount of steam injected into the reservoir.

6. The method of claim 5 wherein the injected steam vapour creates an active steam chamber zone at the distal end of the well which propagates vertically, laterally and along the horizontal portion towards the proximal end of the horizontal well.

7. The method of claim 6 wherein the pressure in the well is controlled by the height of liquid in the vertical portion of the well.

8. The method of claim 7 wherein the heated hydrocarbon, steam condensate and reservoir fluids drain through the foraminous liner under the influence of gravity thereby minimizing sand production.

9. The method of claim 7 wherein the pressure in the annulus is less than the pressure in the reservoir thereby creating a pressure drive within the reservoir.

10. The method of claim 8 wherein said fluids are removed by a downhole pump attached to said vertical portion.

11. The method of claim 10 wherein said fluids are removed by gas lift.

12. The method of claim 10 wherein a thermal packer is placed near the distal end of the steam injection tubing to increase the pressure of the steam so as to increase the penetration of the steam into the reservoir.

13. The method according to claim 10 wherein said cemented well is provided with thermal concrete.

14. The method according to claim 13 wherein prior to injecting steam vapour and hot water condensate into the steam injection tubing, between about 5 and 10% of the in-well hydrocarbons are removed.

15. The method of claim 2 wherein during the subsequent stage, production from the well is decreased so as to increase the well pressure and thereby increase the amount of steam injected into the reservoir.

16. The method of claim 3 wherein during the subsequent stage, production from the well is decreased so as to increase the well pressure and thereby increase the amount of steam injected into the reservoir.

17. The method of claim 1 wherein the injected steam vapour creates an active steam chamber zone at the distal end of the well which propagates vertically, laterally and along the horizontal portion towards the proximal end of the horizontal well.

18. The method of claim 9 wherein said fluids are removed by a downhole pump attached to said vertical portion.

19. The method of claim 10 wherein said fluids are removed by steam lift.

20. A method for recovering heavy oil from reservoirs in thin formations, which formations are provided with a drilled, cased and cemented well having an insulated vertical portion and an insulated horizontal portion with insulation substantially to said distal end wherein there is a foraminous liner along the horizontal portion, said method comprising:

(a) removing the hydrocarbons from the region of the reservoir adjacent the horizontal portion of the well;

(b) creating a steam chamber in the reservoir at the distal end of the horizontal portion remote from the vertical portion by transporting steam through said insulated vertical portion and through said insulated horizontal portion to said distal end;

(c) propagating said steam chamber vertically from and horizontally along the horizontal portion from the distal end of the horizontal portion towards a proximal end of the horizontal portion;

(d) producing to the surface, oil, reservoir fluids and steam condensate which have drained from the reservoir through the foraminous liner.

* * * * *